US007413403B2

(12) United States Patent
Cunha et al.

(10) Patent No.: US 7,413,403 B2
(45) Date of Patent: Aug. 19, 2008

(54) TURBINE BLADE TIP COOLING

(75) Inventors: Francisco J. Cunha, Avon, CT (US); Jason E. Albert, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 265 days.

(21) Appl. No.: 11/317,394

(22) Filed: Dec. 22, 2005

(65) Prior Publication Data

US 2007/0147997 A1 Jun. 28, 2007

(51) Int. Cl.
*F01D 5/08* (2006.01)

(52) U.S. Cl. ..... 416/1; 416/97 R; 416/92; 164/369; 164/397

(58) Field of Classification Search ..... 415/115; 416/97 R, 92, 1; 164/369, 397
See application file for complete search history.

(56) References Cited

U.S. PATENT DOCUMENTS 5,403,159 A * 4/1995 Green et al. ..... 416/97 R
5,462,405 A 10/1995 Hoff et al.
5,857,837 A * 1/1999 Zelesky et al. ..... 416/97 R
5,902,093 A * 5/1999 Liotta et al. ..... 416/97 R
5,931,638 A * 8/1999 Krause et al. ..... 416/97 R
6,637,500 B2 * 10/2003 Shah et al. ..... 164/369
6,824,359 B2 11/2004 Chlus et al.
6,974,308 B2 12/2005 Halfmann et al.
2004/0146401 A1 7/2004 Chlus et al.

* cited by examiner

*Primary Examiner*—Ninh H Nguyen
(74) *Attorney, Agent, or Firm*—Bachman & LaPointe, P.C.

(57) ABSTRACT

A turbine engine blade has an attachment root, a platform outboard of the attachment root, and an airfoil extending from the platform. The airfoil has pressure and suction sides extending between leading and trailing edges. An internal cooling passageway network includes at least one inlet in the root and a plurality of outlets along the airfoil. The passageway network includes a leading spanwise cavity fed by a first trunk. A streamwise cavity is inboard of a tip of the airfoil. A spanwise feed cavity feeds the streamwise cavity absent down-pass. A second trunk feeds the spanwise feed cavity.

20 Claims, 4 Drawing Sheets

TURBINE BLADE TIP COOLING

BACKGROUND OF THE INVENTION

The invention relates to gas turbine engines. More particularly, the invention relates to cooled gas turbine engine blades.

Heat management is an important consideration in the engineering and manufacture of turbine engine blades. Blades are commonly formed with a cooling passageway network. A typical network receives cooling air through the blade platform. The cooling air is passed through convoluted paths through the airfoil, with at least a portion exiting the blade through apertures in the airfoil. These apertures may include holes (e.g., "film holes") distributed along the pressure and suction side surfaces of the airfoil and holes at junctions of those surfaces at leading and trailing edges. Additional apertures may be located at the blade tip. In common manufacturing techniques, a principal portion of the blade is formed by a casting and machining process. During the casting process a sacrificial core is utilized to form at least main portions of the cooling passageway network.

In turbine engine blades (especially high pressure turbine (HPT) section blades), thermal fatigue of tip region of a blade airfoil is one area of particular concern. U.S. Pat. No. 6,824,359 discloses cooling air outlet passageways fanned along a trailing tip region of the airfoil. US Pregrant Publication No. 2004/0146401 discloses direction of air through a relief in a wall of a tip pocket to cool a trailing tip portion. U.S. Pat. No. 6,974,308 discloses use of a tip flag passageway to deliver a high volume of cooling air to a trailing tip portion.

SUMMARY OF THE INVENTION

One aspect of the invention involves a turbine engine blade having an attachment root, a platform outboard of the attachment root, and an airfoil extending from the platform. The airfoil has pressure and suction sides extending between leading and trailing edges. An internal cooling passageway network includes at least one inlet in the root and a plurality of outlets along the airfoil. The passageway network includes a leading spanwise cavity fed by a first trunk. A streamwise cavity is inboard of a tip of the airfoil. A spanwise feed cavity feeds the streamwise cavity absent down-pass. A second trunk feeds the spanwise feed cavity.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
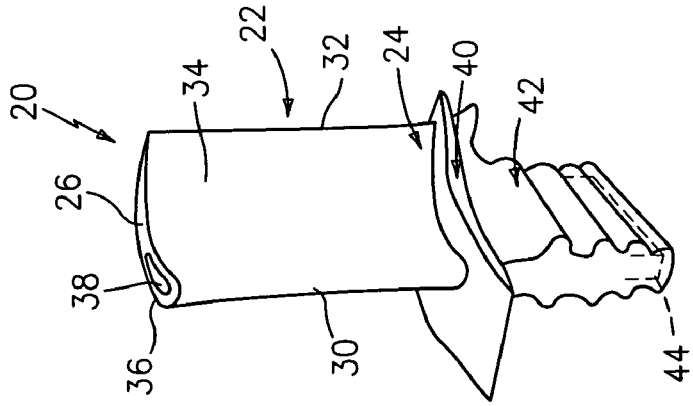
FIG. 1 is a view of a gas turbine engine blade.

FIG. 1 shows a blade 20 (e.g., an HPT blade) having an airfoil 22 extending along a span from an inboard end 24 to an outboard tip 26. The blade has leading and trailing edges 30 and 32 and pressure and suction sides 34 and 36. A tip compartment 38 may be formed recessed below a remaining portion of the tip 26.

A platform 40 is formed at the inboard end 24 of the airfoil and locally forms an inboard extreme of a core flowpath through the engine. A convoluted so-called "fir tree" attachment root 42 depends from the underside of the platform 40 for attaching the blade to a separate disk. One or more ports 44 may be formed in an inboard end of the root 42 for admitting cooling air to the blade. The cooling air may pass through a passageway system and exit through a number of outlets along the airfoil. As so far described, the blade 40 may be representative of many existing or yet-developed blade configurations. Additionally, the principles discussed below may be applied to other blade configurations.

Figure 2:
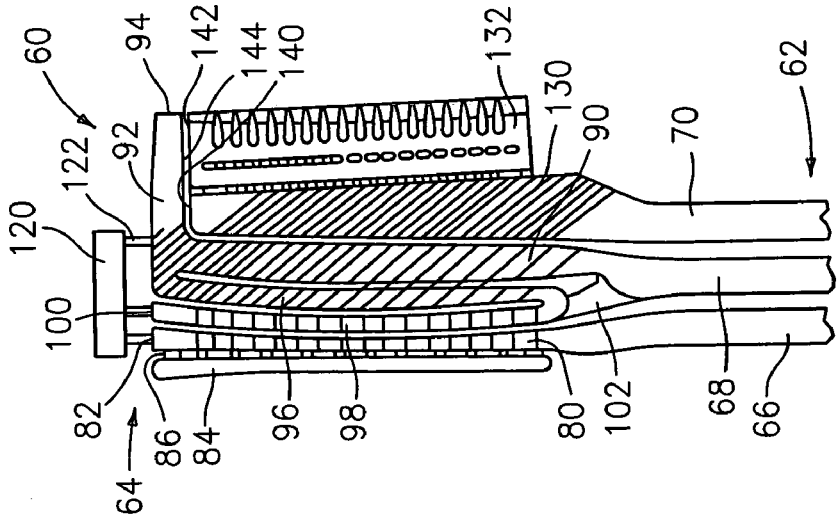
FIG. 2 (PRIOR ART)
FIG. 2 is a view of a first prior art casting core for forming blade cooling passageways.

FIG. 2 shows an exemplary prior art core 60 used to cast major portions of a passageway system of a prior art blade. The exemplary core 60 may be formed of one or more molded ceramic pieces assembled to each other or to additional components such as refractory metal cores. For ease of reference, core directions are identified relative to associated directions of the resulting blade cast using the core. Similarly, core portions may be identified with names corresponding to associated passageway portions formed when those core portions are removed from a casting. Additional passageway portions may be drilled or otherwise machined.

The core 60 extends from an inboard end 62 to an outboard/tip end 64. Three trunks 66, 68, and 70 extend tipward from the inboard end 62. The trunks extend within the root of the resulting blade and form associated passageway trunks. The trunks may be joined at the inboard end (typically in a portion of the core that is embedded in a casting shell and falls outside the blade root). The leading trunk 66 joins/feeds a first spanwise feed passageway portion 80 extending to a tip end 82. The feed passageway portion 80 is connected to a leading edge impingement chamber/cavity portion 84. The cavity cast by the portion 84 may be impingement fed by airflow from the feed passageway cast by the portion 80, the air passing through a series of apertures cast by connecting posts 86. The cavity may then cool a leading edge portion of the airfoil via drilled or cast outlet holes.

The second trunk 68 joins a spanwise passageway portion 90 having a distal end merged with a proximal end of streamwise extending portion 92. In the vernacular, the portion 92 is a tip flag portion and the portion 90 is a flagpole portion. The flag portion 92 extends downstream toward the trailing edge adjacent the tip end and has a distal/downstream end 94. The outboard end of the portion 90 also joins a spanwise down-pass portion 96 thereahead. At its inboard end, the down-pass portion 96 joins an up-pass portion 98 extending to an outboard end 100. In operation, air flows outboard through the second trunk passageway and the flagpole/feed passageway formed by the portion 90. At the downstream end of the flagpole passageway, a major portion of that air flows into the flag passageway ultimately exiting at outlets near the downstream end thereof. Another air portion returns back inboard through the down-pass and then proceeds outboard through the up-pass. A connector 102 may have a relatively small cross-sectional area and may serve a structural role in providing core rigidity. A connecting passageway initially formed by a connector 102 may be blocked (e.g., with a ball braze) to prevent air bypass directly from the trunk to the up-pass.

A core portion 120 may serve to cast the tip pocket. To hold this portion 120, connecting portions 122 join the portion 120 to the ends 82 and 100 and the flag 92. Small amounts of air may pass through holes formed by the connecting portions 122 to feed the tip pocket.

The third trunk 70 joins a trailing edge feed passageway portion 130. Along its trailing extremity, the portion 130 is connected to a discharge slot-forming portion 132. The portion 132 may be unitarily formed with the portion 130 or may be a separate piece (e.g., refractory metal core) secured thereto. Outboard ends 140 and 142 of the portions 130 and 132 are in close proximity to an inboard edge 144 of the flag 92. A gap between these portions may leave a wall (e.g., continuous with a wall formed between the trunks 60 and 70 and passageway portions 90 and 130) in the cast blade. The wall isolates the air feeding the flag from heating that might otherwise occur if the flag were fed via the trailing passageway.

Figure 3:
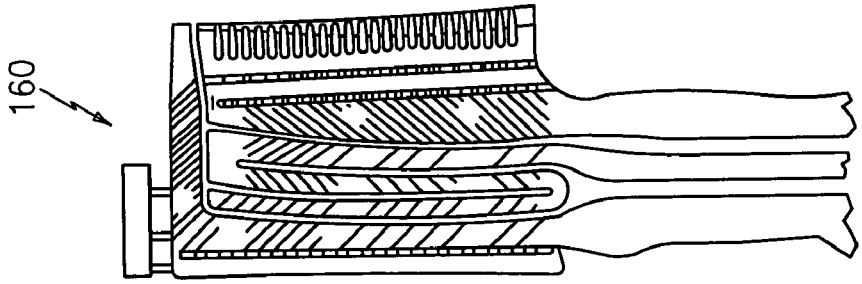
FIG. 3 (PRIOR ART)
FIG. 3 is a view of a second prior art casting core for forming blade cooling passageways.

FIG. 3 shows an alternate core 160 for forming a blade wherein the flag is fed via a leading trunk and from a spanwise flagpole passageway that also impingement feeds a leading edge cavity.

Figure 4:
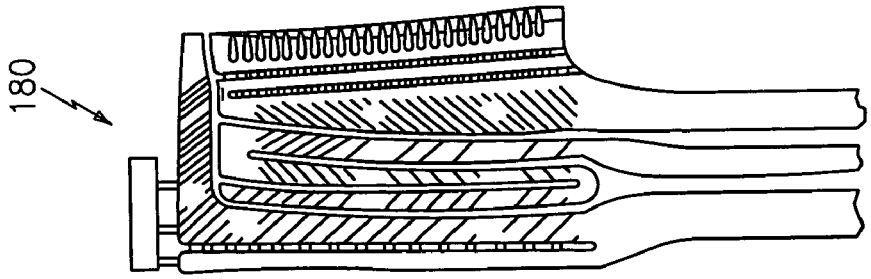
FIG. 4 (PRIOR ART)
FIG. 4 is a view of a third prior art casting core for forming blade cooling passageways.

FIG. 4 shows an alternate core wherein the leading edge cavity is both impingement fed from the flagpole passageway and fed from the leading trunk.

Figure 6:
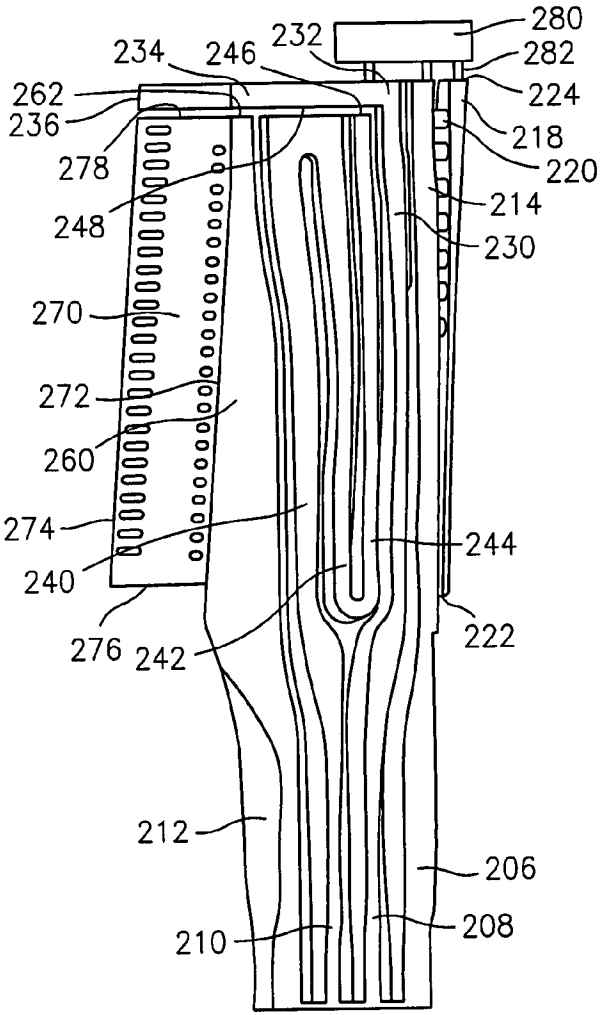
FIG. 6 is a second side view of the core of FIG. 5.
Figure 5:
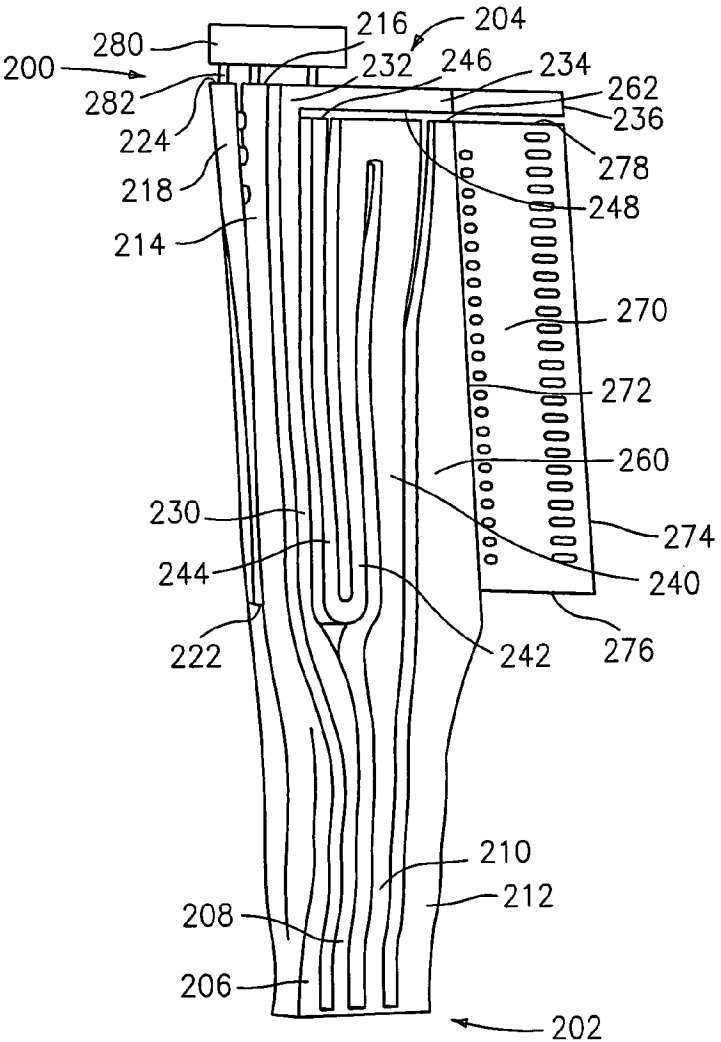
FIG. 5 is a first side view of a core according to principles of the invention.

FIG. 5 shows an inventive core 200 extending from an inboard end 202 to a tip end 204. Extending from the inboard end 202 are four trunks 206, 208, 210, and 212. The lead trunk 206 extends to a spanwise passageway portion 214 having an outboard end 216. Along its leading face, the passageway portion 214 is connected to a cavity-forming portion 218 by a number of connectors 220 (FIG. 6). The portion 218 has a terminal inboard end 222 and an outboard end 224.

The trunk 208 extends to a spanwise passageway portion 230 having an outboard end junction 232 with the upstream/leading end of a flag portion 234. The flag portion 234 extends to a terminal downstream/trailing end 236.

The trunk 210 extends to a spanwise up-pass passageway portion 240 having a distal/outboard end joining an outboard end of a spanwise down-pass portion 242. The down-pass portion 242 has an inboard end joining an inboard end of a spanwise second up-pass portion 244. The up-pass portion 244 extends to a terminal end 246 inboard of an inboard edge 248 of the flag 234.

The final/trailing trunk 212 extends to a spanwise passageway portion 260. The portion 260 extends to an outboard terminal end 262 spaced apart from the flag inboard edge 248. A core portion 270 extends downstream from a trailing extremity 272 of the core portion 260 to a trailing edge 274. The core portion 270 has an inboard edge 276 and an outboard edge 278. The outboard edge 278 is spaced apart from the inboard edge 248 of the flag portion 234. The portion 270 may have multiple arrays of apertures for casting posts in a discharge/outlet slot of the airfoil.

A tip pocket portion 280 is joined to the remainder of the core by one or more connectors 282.

In an exemplary core 200, the trunks and their associated passageway portions may be unitarily molded of a ceramic as a single piece. The tip pocket portion may be a portion of the same piece or may be separately molded and secured thereto (e.g., with the connectors 282 acting as mounting studs). The core portion 270 may be formed in the same ceramic molding or may be separately formed. For example, the portion 270 may be formed from a refractory metal sheet secured in a slot along the trailing edge of the passageway portion 260. Similarly, a terminal portion of the flag 234 may be formed from a refractory metal.

Figure 7:
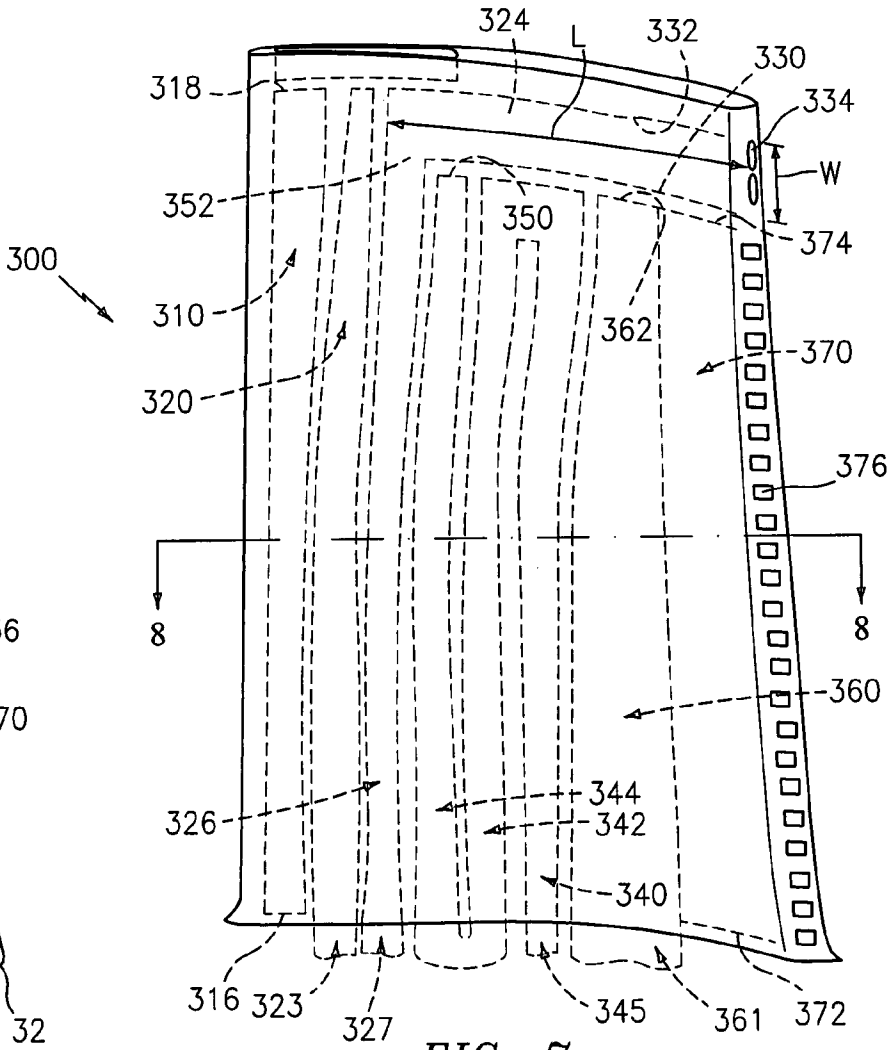
FIG. 7 is a view of an airfoil of a blade cast using the core of FIG. 5.
Figure 8:
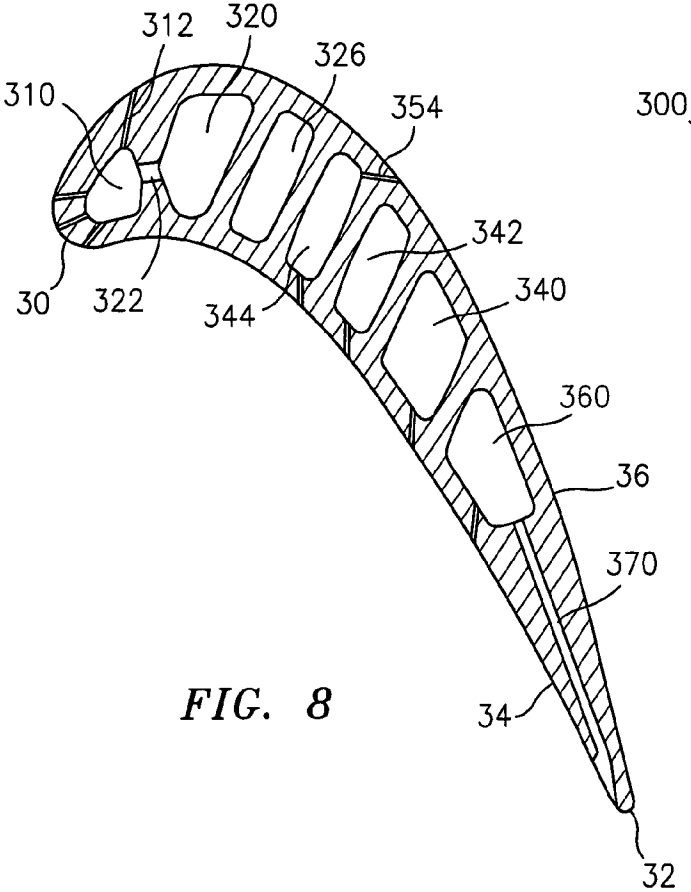
FIG. 8 is a cross-sectional view of the airfoil of FIG. 7, taken along line 8-8.

FIGS. 7 and 8 show further details of the blade cast by the core 200. Along the majority of the airfoil span, there are a series of spanwise elongate passageways or portions thereof. In the exemplary airfoil, these include a leading edge impingement cavity 310 cast by the core portion 218. Drilled or cast outlets 312 may extend to the airfoil pressure or suction side surfaces. The cavity 310 has terminal inboard and outboard ends 316 and 318.

Next downstream is a supply passageway 320 connected to the cavity 310 by impingement ports 322. The supply passageway 320 is fed by a dedicated leading trunk 323 cast by the trunk 206.

The flag passageway 324 is shown in FIG. 7 and its spanwise flagpole/feed passageway 326 are also shown in FIG. 8. The flagpole passageway 326 extends from a dedicated trunk 327 cast by the core trunk 208 and is positioned immediately downstream of the passageway 320. The exemplary flag passageway 324 has a streamwise length L which is a majority of the local streamwise length of the airfoil (e.g., measured along the airfoil mean). The exemplary flag passageway 324 has a width W which is less than the length (e.g., 10-20% of L). The flag passageway 324 has inboard and outboard sides 330 and 332 and pressure and suction sides adjacent the respective pressure and suction sides of the airfoil. The flag passageway 324 has one or more outlets 334 adjacent or exactly along the trailing edge.

Downstream of the flagpole passageway 326 is a circuitous passageway formed by an up-pass 340, a down-pass 342, and an up-pass 344 (respectively cast by core portions 240, 242, and 244). The up-pass 340 is fed by a dedicated trunk 345 (cast by the core trunk 210) to, in turn, feed the down-pass 342 and up-pass 344 in a partially counterflow arrangement relative to the airfoil streamwise direction. The circuit has an end or terminus 350 adjacent a junction 352 of the flag passageway 324 and flagpole passageway 326. Along the circuit, there may be outlet holes 354 (FIG. 8) (e.g., drilled or cast) to the pressure and/or suction side surfaces. A trailing feed passageway 360 (cast by the passageway portion 260) extends spanwise from a dedicated trunk 361 (cast by the core trunk 212) to an upward/distal end 362. A trailing edge discharge slot 370 (cast by the core portion 270) extends downstream from the passageway 360. The slot 370 has inboard and outboard ends 372 and 374 and an array of outlets 376.

Figure 9:
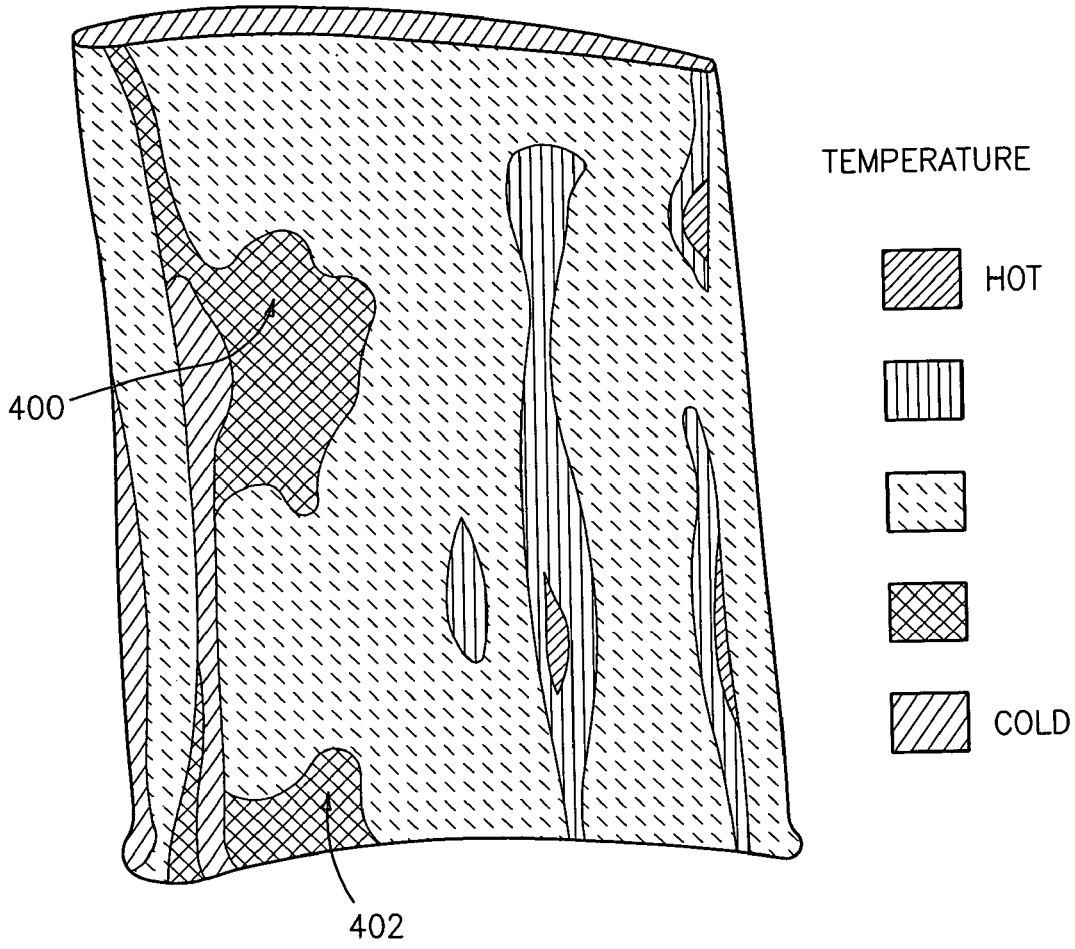
FIG. 9 is a diagram of aerodynamic surface heating for the airfoil of FIG. 7.

Relative to the prior art airfoils cast by the cores of FIGS. 2-4, the passageway arrangement of the blade 300 may have one or more of several advantages. It may be desirable to minimize heating of cooling air before it reaches the flag passageway. Minimizing heating may involve several considerations. One consideration is the position of the flagpole passageway relative to aerodynamically heated regions of the pressure and suction side surfaces 34 and 36. FIG. 9 shows a computed aerodynamic heating of a suction side surface. The exact heat distribution will depend upon airfoil shape and operational parameters. However, with these parameters fixed, and subject to other manufacturing and performance constraints, a routing of the flagpole passageway may be chosen to be aligned with relatively low temperature regions 400 and 402 while avoiding higher adjacent higher temperature regions.

Other considerations regarding the temperature and amount of air reaching the flag tip passageway involve the interplay of other passageways. If the flagpole passageway or its associated trunk directly feed another passageway, factors influencing the diversion of airflow to such other passageway may affect cooling along the flag tip passageway. For example, in the airfoil cast by the FIG. 3 core 160, a leading edge impingement cavity is directly fed by the flagpole passageway. Various aerodynamic considerations (including blade rotational speed, altitude, and fueling) may influence the amount of air discharged from the impingement cavity through its outlet holes. This, in turn, affects the airflow available for the flag passageway. This effect may also be observed in an airfoil cast from the FIG. 4 core 180 wherein the leading edge impingement cavity is additionally fed by a leading trunk shared with the flagpole passageway. Similar effects may be observed in an airfoil cast by the core 60 of FIG. 2 wherein the flagpole passageway and its associated trunk feed a mid-foil down-pass/up-pass circuit.

The foregoing principles may be implemented in the reengineering of a blade, its associated engine, or any intermediate. Such a reengineered blade may, in turn, be used either in a new engine or in a remanufacture/retrofit situation. A basic reengineering of a blade, alone, would preserve the external profile of the root, platform, and airfoil. Extensive reengineering might change airfoil shape responsive to the available cooling afforded by the flag passageway.

An exemplary reengineering involves a baseline configuration including a streamwise tip passageway. The baseline tip passageway may be fed with at least one of: a circuitous up-pass/down-pass/up-pass combination; and a greater than 10% (more narrowly, greater than 20%) diversion from an associated trunk. The reengineering (or an engineering) may comprise: determining an aerodynamic heating distribution; and positioning a feed passageway for a streamwise tip passageway so as to avoid an undesired heating of cooling air delivered to the tip passageway through the feed passageway The feed passageway may be configured to provide 0-20% (more narrowly, 0-10%) diversion of an inlet airflow providing the cooling air delivered to the tip passageway. Relative to the baseline configuration, the reengineered configuration may add at least one trunk. Relative to the baseline, the reengineering may provide at least one of: reducing an operational air temperature increase at a downstream end of a spanwise feed passageway relative to a blade inlet temperature, the spanwise feed passageway feeding a streamwise elongate tip end passageway; and providing a dedicated passageway trunk to feed a final configuration spanwise feed passageway feeding a final configuration streamwise elongate tip end passageway whereas the blade baseline configuration has one fewer passageway trunks and a baseline configuration spanwise feed passageway feeding a baseline configuration streamwise elongate tip end passageway is fed by a trunk shared with another spanwise passageway.

The resulting airfoil may be cooled by passing a plurality of trunk airflows into the airfoil. An airflow of said trunk airflow may be passed into a streamwise cavity inboard of the tip absent-downpass and with 0.20% diversion. A portion of the diversion may be passed into an open tip cavity. The passing of the airflow may comprise passing from a trunk cavity through a spanwise feed cavity and into a leading end of the streamwise cavity. The passing of the airflow may comprise discharging from an outlet along the trailing edge. Another airflow of said trunk airflows may be passed into a leading spanwise cavity. Another airflow of said trunk airflows may be passed into a trailing spanwise cavity (e.g., and discharged from a wailing edge slot). A portion of another of the trunk airflows may be passed into the open tip cavity.

One or more embodiments of the present invention have been described. Nevertheless, it will be understood that various modifications may be made without departing from the spirit and scope of the invention. Accordingly, other embodiments are within the scope of the following claims.

What is claimed is:

1. A turbine engine blade comprising:
an attachment root;
a platform outboard of the attachment root;
an airfoil extending from the platform and having:
leading and trailing edges;
pressure and suction sides extending between the leading and trailing edges; and
a tip; and
an internal cooling passageway network having:
at least one inlet in the attachment root; and
a plurality of outlets along the airfoil,
wherein:
the cooling passageway network comprises:
a leading spanwise cavity;
a first trunk feeding the leading spanwise cavity;
a streamwise cavity inboard of the tip;
a spanwise feed cavity feeding the streamwise cavity absent down-pass;
a second trunk feeding the spanwise feed cavity;
a mid-body passageway comprising:
a first spanwise up-pass;
a spanwise down-pass fed by the first spanwise up-pass; and
a second spanwise up-pass fed by the spanwise down-pass;
a third trunk feeding the first spanwise un-pass;
a trailing spanwise cavity; and
a fourth trunk feeding the trailing spanwise cavity.

2. The blade of claim 1 wherein:
the leading spanwise cavity is an impingement cavity; and
a spanwise impingement feed cavity extends from the first trunk to impingement feed the leading spanwise cavity.

3. The blade of claim 1 wherein:
the streamwise cavity has a streamwise length at least 60% of a local streamwise length of the airfoil.

4. The blade of claim 1 formed as a single casting.

5. The blade of claim 1 further comprising:
a tip cavity partially fed by the first trunk and partially fed by the second trunk.

6. A method for cooling a turbine engine blade airfoil comprising:
passing a plurality of trunk airflows into the airfoil;
passing an airflow of said trunk airflows into a streamwise cavity inboard of the tip absent down-pass and with 0-20% diversion; and
passing a portion of said diversion into an open tip cavity.

7. The method of claim 6 wherein:
the passing of the airflow comprises passing from a trunk cavity through a spanwise feed cavity and into a leading end of the streamwise cavity.

8. The method of claim 7 wherein:
the passing of the airflow comprises discharging from an outlet along the trailing edge.

9. The method of claim 6 further comprising:
passing another airflow of said trunk airflows into a leading spanwise cavity.

10. The method of claim 6 further comprising:
passing another airflow of said trunk airflows into a trailing spanwise cavity.

11. The method of claim 10 wherein:
the passing of said another airflow comprises discharging from a trailing edge slot.

12. The method of claim 6 further comprising:

passing a portion of another of the trunk airflows into the open tip cavity.

13. A casting core for forming a turbine engine blade and comprising:

a root end and a tip end;

a pressure side and a suction side;

a leading spanwise portion;

a first trunk portion;

means linking the first trunk portion and the leading spanwise portion;

a streamwise elongate portion inboard of the tip;

a second trunk portion;

means noncircuitiousty linking the second trunk portion and the streamwise elongate portion;

a circuitous intermediate portion including three spanwise portions;

a third trunk coupled to the intermediate portion;

a trailing spanwise portion;

means for forming a discharge slot either unitarily formed with or secured to the trailing spanwise portion; and a fourth trunk portion coupled to the trailing spanwise portion.

14. A method for engineering a turbine engine blade comprising:

determining an aerodynamic heating distribution;

positioning a feed passageway for a streamwise tip passageway to as to avoid an undesired heating of cooling air delivered to the tip passageway through the feed passageway; and configuring the feed passageway to provide 0-20% diversion of an inlet airflow providing the cooling air delivered to the tip passageway.

15. The method of claim 14 being a reengineering from a baseline configuration to a reengineered configuration and wherein:

the reengineered configuration adds at least one trunk relative to the baseline configuration; and the baseline configuration includes a streamwise tip passageway fed with at least one of:

a greater than 10% diversion from an associated trunk; and a circuitous up-pass/down-pass/up-pass combination.

16. The method of claim 14 being a reengineering from a baseline configuration to a reengineered configuration and wherein:

the reengineered configuration adds at least one trunk relative to the baseline configuration;

the reengineered configuration provides 0-10% diversion of an inlet airflow providing the cooling air delivered to the tip passageway; and the baseline configuration includes a streamwise tip passageway fed with at least one of:

a greater than 20% diversion from an associated trunk; and a circuitous up-pass/down-pass/up-pass combination.

17. A method for remanufacturing a turbine engine or reengineering a configuration of said turbine engine, the remanufacturing or reengineering being from a baseline configuration to a final configuration and comprising:

reconfiguring a cooling passageway system of a blade from a baseline configuration to a final configuration so as to provide at least one of:

reduce an operational air temperature increase at a downstream end of a spanwise feed passageway relative to a blade inlet temperature, the spanwise feed passageway feeding a streamwise elongate tip end passageway; and provide a dedicated passageway trunk to feed a final configuration spanwise feed passageway feeding a final configuration streamwise elongate tip end passageway whereas the blade baseline configuration has one fewer passageway trunks and a baseline configuration spanwise feed passageway feeding a baseline configuration streamwise elongate tip end passageway is fed by a trunk shared with another spanwise passageway.

18. The method of claim 17 wherein:

reconfiguring includes said provision of a dedicated passageway trunk by adding at least one trunk to a trunk number of the baseline configuration.

19. A method for reengineering a turbine blade from a baseline configuration to a reengineered configuration, the method comprising:

determining an aerodynamic heating distribution;

positioning a feed passageway for a streamwise tip passageway to as to avoid an undesired heating of cooling air delivered to the tip passageway through the feed passageway, wherein:

the reengineered configuration adds at least one trunk relative to the baseline configuration; and the baseline configuration includes a streamwise tip passageway fed with at least one of:

a greater than 10% diversion from an associated trunk; and a circuitous up-pass/down-pass/up-pass combination.

20. A method for reengineering a turbine blade from a baseline configuration to a reengineered configuration, the method comprising:

determining an aerodynamic heating distribution;

positioning a feed passageway for a streamwise tip passageway to as to avoid an undesired heating of cooling air delivered to the tip passageway through the feed passageway, wherein:

the reengineered configuration adds at least one trunk relative to the baseline configuration;

the reengineered configuration provides 0-10% diversion of an inlet airflow providing the cooling air delivered to the tip passageway; and the baseline configuration includes a streamwise tip passageway fed with at least one of:

a greater than 20% diversion from an associated trunk; and a circuitous up-pass/down-pass/up-pass combination.

* * * * *

UNITED STATES PATENT AND TRADEMARK OFFICE

CERTIFICATE OF CORRECTION

PATENT NO. : 7,413,403 B2
APPLICATION NO. : 11/317394
DATED : August 19, 2008
INVENTOR(S) : Francisco J. Cunha et al.

It is certified that error appears in the above-identified patent and that said Letters Patent is hereby corrected as shown below:

In column 6, claim 1, line 30, delete “un-pass” and insert --up-pass--.

In column 7, claim 13, line 14, delete “noncircuitiousty” and insert --noncircuitiously--.

In column 7, claim 14, line 28, delete “to as to” and insert --so as to--.

In column 8, claim 19, line 29, delete “to as to” and insert --so as to--.

In column 8, claim 20, line 45, delete “to as to” and insert --so as to--.

Signed and Sealed this

Twenty-first Day of October, 2008

JON W. DUDAS
*Director of the United States Patent and Trademark Office*